US007214002B2

(12) United States Patent
Laine

(10) Patent No.: US 7,214,002 B2
(45) Date of Patent: May 8, 2007

(54) WATER FEATURE KIT

(75) Inventor: Scott Laine, Orland, CA (US)

(73) Assignee: L&W Stone, Orlando, CA (US)

( * ) Notice: Subject to any disclaimer, the term of this patent is extended or adjusted under 35 U.S.C. 154(b) by 534 days.

(21) Appl. No.: 10/766,694

(22) Filed: Jan. 27, 2004

(65) Prior Publication Data

US 2005/0011144 A1 Jan. 20, 2005

Related U.S. Application Data

(60) Provisional application No. 60/443,082, filed on Jan. 27, 2003, provisional application No. 60/465,820, filed on Apr. 25, 2003.

(51) Int. Cl.
*B65G 5/00* (2006.01)

(52) U.S. Cl. ..... 405/53; 405/52; 405/55

(58) Field of Classification Search ..... 405/52, 405/53, 54, 55; 210/169, 170
See application file for complete search history.

(56) References Cited

U.S. PATENT DOCUMENTS

| | | | | |
|---|---|---|---|---|
| 6,041,738 | A * | 3/2000 | Hemauer et al. | 119/226 |
| 6,290,844 | B1 * | 9/2001 | Tennyson, Jr. | 210/169 |
| 6,709,580 | B2 * | 3/2004 | Ouwinga | 210/169 |
| 6,843,910 | B1 * | 1/2005 | Thomas | 210/167 |
| 6,944,998 | B1 * | 9/2005 | King | 52/314 |
| 2004/0182765 | A1 * | 9/2004 | Mauro et al. | 210/169 |
| 2004/0226870 | A1 * | 11/2004 | Sonnenberg | 210/167 |

OTHER PUBLICATIONS

PondSolutions.com "Pond Liner Installation Procedures" Mar. 3, 2000.*

* cited by examiner

*Primary Examiner*—Frederick L. Lagman
(74) *Attorney, Agent, or Firm*—Black Lowe & Graham, PLLC

(57) ABSTRACT

A kit for building a water feature, in which all of the materials necessary to construct a pond are provided in a single container. In an alternate form, all materials necessary to build a waterfall or other water feature are provided in a single container.

5 Claims, 10 Drawing Sheets

WATER FEATURE KIT

PRIORITY CLAIM

This application claims the benefit of prior U.S. Provisional Application Ser. No. 60/443,082, entitled "Pond Kit" and filed Jan. 27, 2003, and prior U.S. Provisional Application Ser. No. 60/465,820, entitled "Pond Kit" filed Apr. 25, 2003. Both provisional applications are incorporated by this reference.

FIELD OF THE INVENTION

This invention relates generally to landscaping, particularly including water features such as ponds and waterfalls.

BACKGROUND OF THE INVENTION

The creation of ponds, waterfalls, or other water features has proven difficult for most homeowners for a variety of reasons. For example, many simply do not know how to build a water feature. Others cannot find the necessary materials or do not appreciate what materials might be required. In still other cases, the building materials for a pond or other water feature are not readily accessible in a single location, but rather must be purchased from several different stores widely separated from one another. Consequently, the construction of a home water feature can be a daunting, time-consuming task. Accordingly, there is a need for an improved system that will allow water features to be built quickly and easily.

SUMMARY OF THE INVENTION

The present invention comprises a system for building a water feature. In a preferred form, all of the materials necessary to construct a pond are provided in a single container. In an alternate form, all materials necessary to build a waterfall or other water feature are provided in a single container.

In accordance with other preferred aspects of the invention, the single container includes detailed instructions and construction aids to enable anyone to build a water feature.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
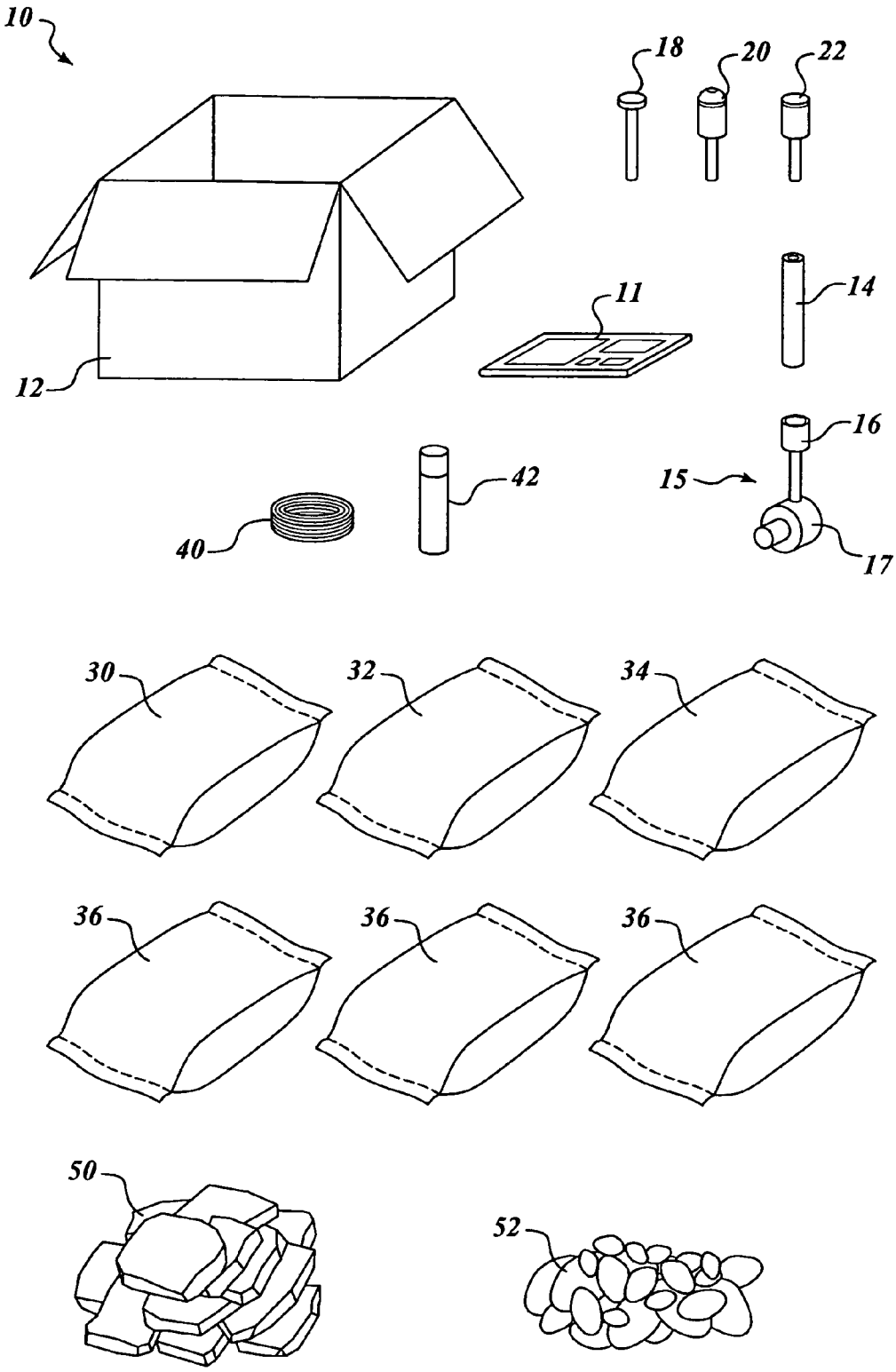
FIG. 1 is an illustration of a water feature kit in accordance with this invention.

FIG. 1 depicts a preferred pond kit 10 in accordance with this invention. The pond kit includes a rugged box 12 sized to hold all of the other components depicted in FIG. 1. The remaining components include a 10 foot by 10 foot liner 14, a pump 15, three fountain nozzles 18, 20, 22, an 80 pound sack of ¼ inch pebbles 30, an 80 pound sack of ⅝ inch pebbles 32, an 80 pound sack of 1½ inch pebbles 34, three sacks of cobble stones 36, a twenty foot shaping cord 40, a can of marking paint 42, 40 linear feet of flagstone 50, and five pieces of wall rock 52. As shown in FIG. 1, all of the components are removed from the box (which is not drawn to scale). When packaged in accordance with the preferred embodiment, all of the components are placed inside the box 12, which is sealed and ready for shipment or sale.

A pond is constructed using the pond kit 10 by selecting a suitable pond location. The best location is one that does not have large tree roots or other impediments. Likewise, if plants or fish are to be used, an area that is at least partially shady is best. The preferred pond kit 10 is sized for a pond having a twenty-foot circumference, and therefore the shaping cord 40 is twenty feet long. The chosen pond location should accommodate a pond having a circumference of twenty feet or less. When constructing a pond kit for larger or smaller ponds, the quantity and magnitude of the components will be scaled accordingly.

Figure 2:
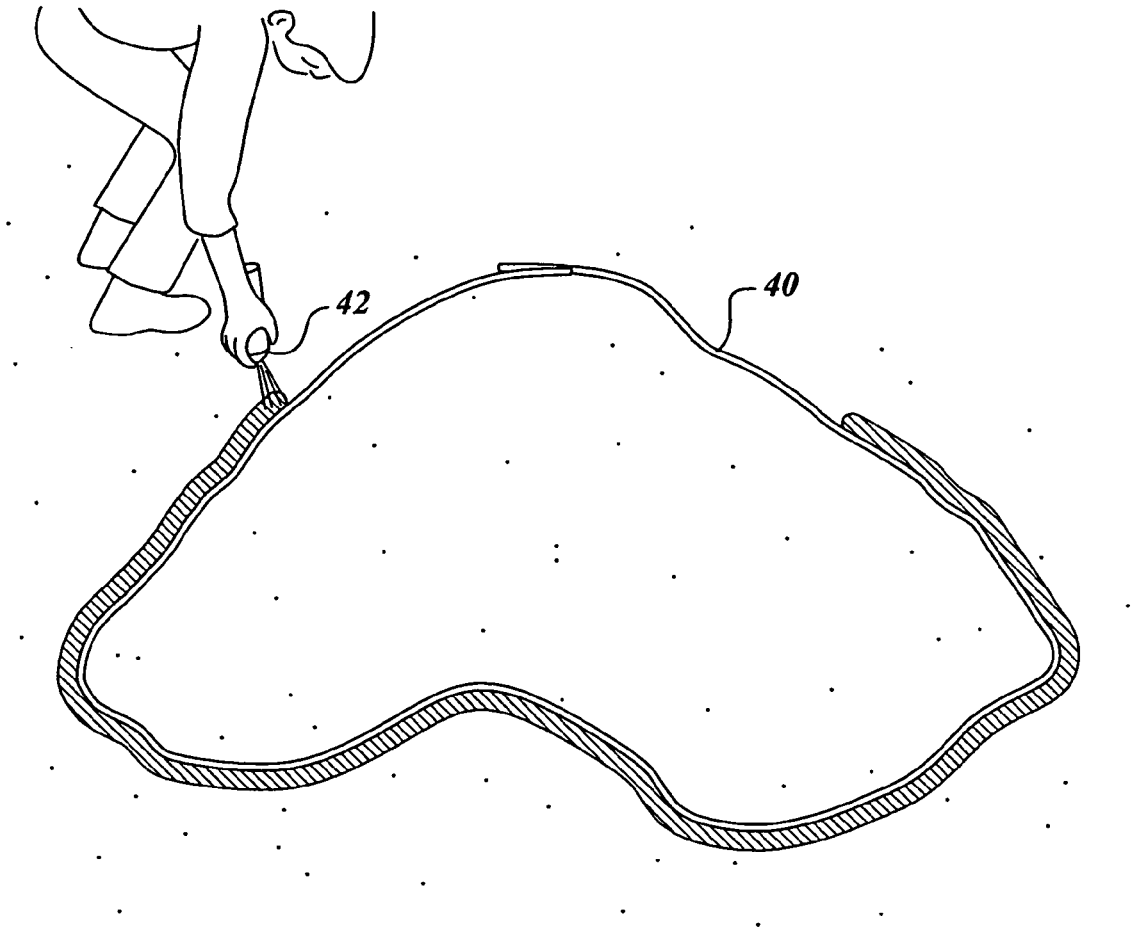
FIG. 2 is a depiction of a location for a pond being marked for excavation.

Once a suitable location is found, the shaping cord 40 is placed on the ground, as shown in FIG. 2, in order to form an outline of a desired pond shape. By using the shaping cord, a pond of any shape can be readily created, including for example round, square, kidney, pear, or other shapes. After the shape has been chosen and the shaping cord placed on the ground in the desired configuration, the marking paint 42 is used to paint an outline of the shape on the ground. After outline of the shape is painted on the ground, earth lying inside the painted outline is removed to a desired depth of below the grade to form an excavation with steeply sloping sides and a substantially level bottom.

Figure 3:
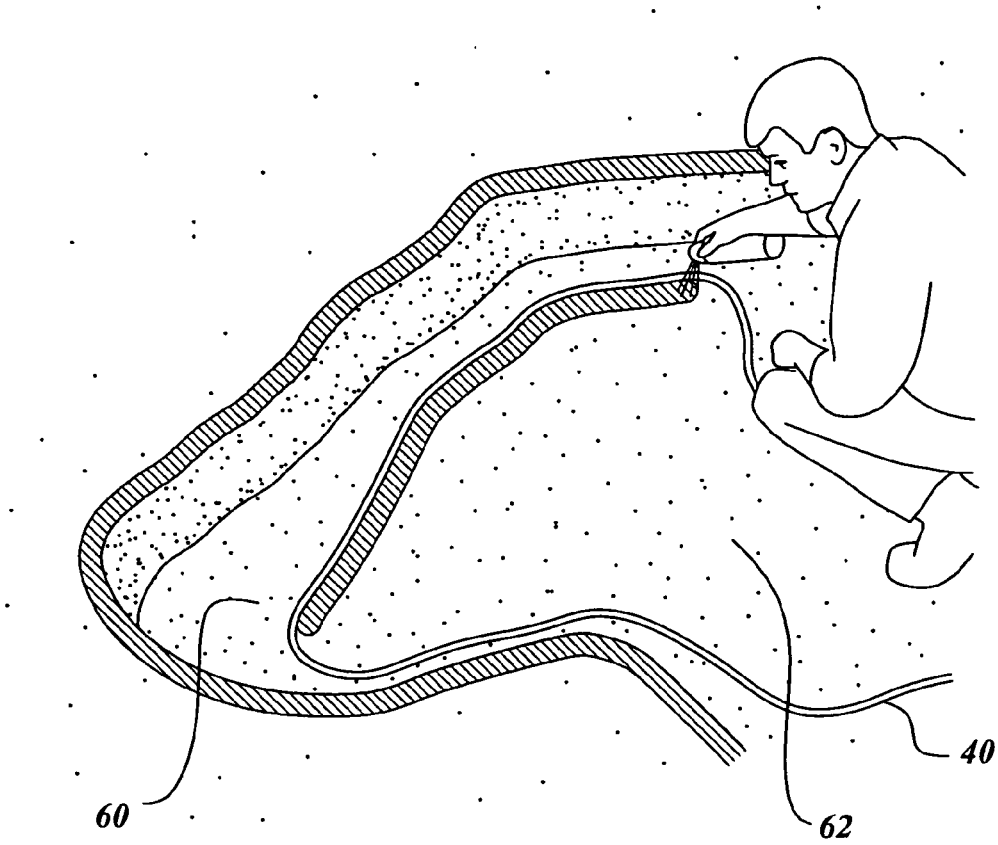
FIG. 3 is a depiction of a planting shelf location for a pond being marked for excavation.

If underwater plants are desired, the substantially level bottom may be used to form a planting shelf. As depicted in FIG. 3, the shaping cord 40 is arranged on the substantially level bottom to outline a planting shelf 60 that is about twelve to eighteen inches wide around the perimeter of the pond as measured from the sloping sides. Again, with the shaping cord 40 in place on the substantially level ground, paint is sprayed immediately inside the shaping cord 40 to outline a perimeter of the planting shelf 60. The marked area defines a boundary between the peripheral planting shelf 60 and an internal pond area 62 at the center.

Figure 4:
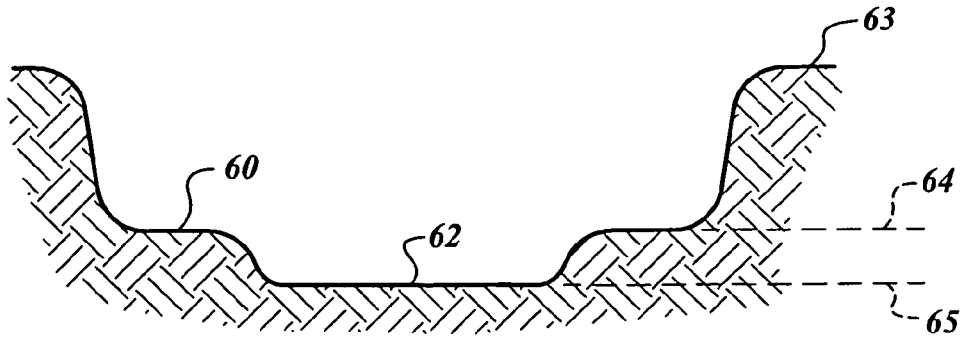
FIG. 4 is an illustration of a cross-section of a preferred pond.

Earth within the painted outline is removed from the internal pond area 62. FIG. 4 is an exemplary cross-section of the excavation resulting after removing the earth as described above. Notable features of the exemplary cross-section of the excavation are the planting shelf 60 and the internal planting area 62. Additionally, the planting shelf level 64 is about twelve inches below grade 63, while the center pond level 65 is about six inches below the planting shelf level 64.

After the designated earth is removed, the liner 14 is placed over remaining earth to line the excavation. The preferred liner 14 is formed from durable plastic sheeting having a smooth surface and a textured surface. The liner 14 is place such that the textured surface of the liner 14 is facing upward. The textured surface of the liner 14 provides sites to enable beneficial algae to form. The liner 14 properly placed in the excavation follows the contours of the excavation without significant wrinkling and extends evenly out of the excavation substantially equally approximately twelve inches beyond the perimeter of the excavation.

The liner 14 is secured in place by setting a suitable plurality of wall rocks 52 and a suitable plurality of the flagstones 50 in place. The flagstones 50 are stones that are generally about two to three inches thick and randomly shaped but about six to twelve inches wide. The wall rocks 52 are similar to flagstone 50, but are somewhat larger, with more height and width. Mixing the two grades of stone together yields a more natural appearing finished water feature. The uniformity and size of the flagstones 50 makes them a more appealing border and approximately seventeen of the flagstones 50 are reserved to form the border dressing the edge of the pond.

Figure 5:
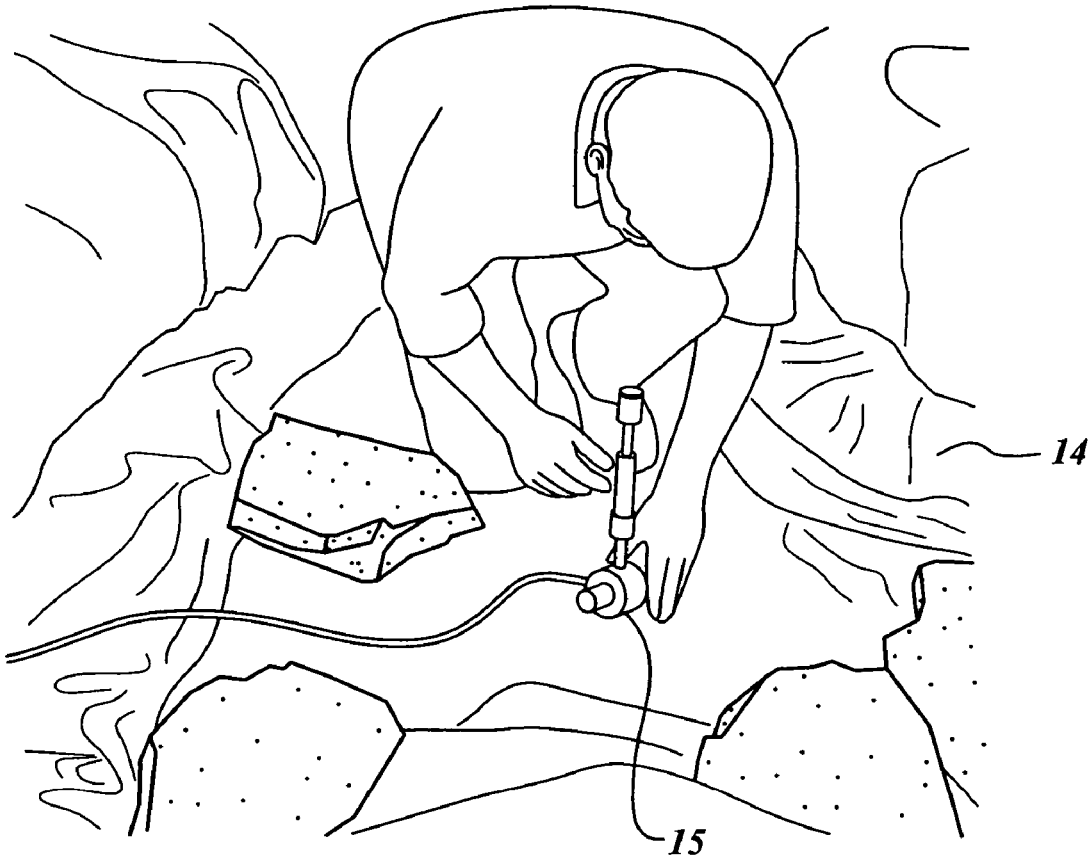
FIG. 5 is a depiction of a preferred pond containing a liner, center stones, and pump.

Next, the pond pump 15 is installed, as shown in FIG. 5. The pump 15 includes a pump motor and body 17 and a fountain head 16. The pump body 17 is placed on the floor of the pond resting on the liner 14 in the center section, with the fountain head 16 extending upward and out of where the surface of the water is expected to be. Three fountain nozzles are provided in the kit, including a waterbell nozzle 18, a daisy nozzle 20, and a tulip nozzle 22. One of the nozzles is selected and placed in the fountain head 16 to produce the desired fountain shape. Any number of alternative or additional nozzle configurations may also be used.

Figure 6:
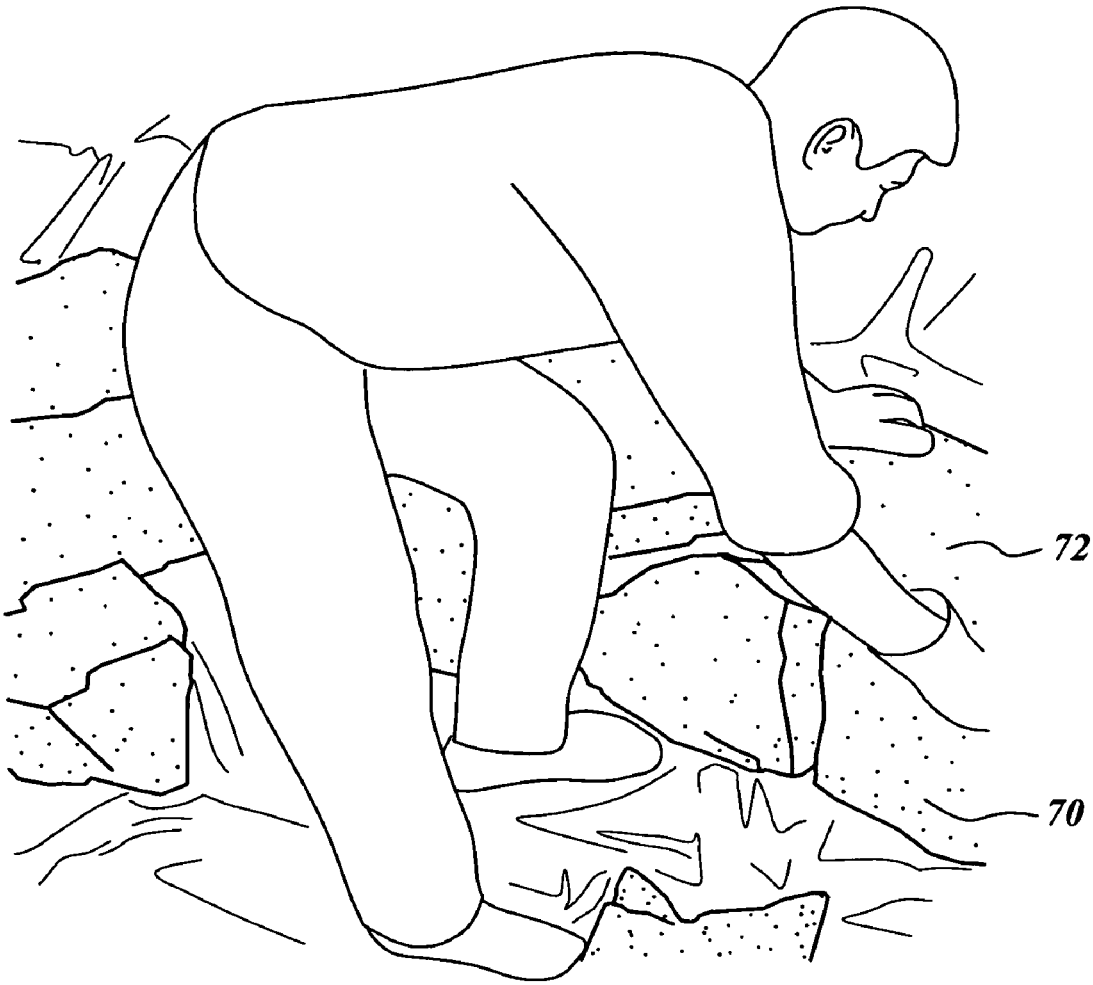
FIG. 6 is a depiction of a preferred pond with edge stones being installed.

Once the pond is in place, the edge of the pond can be dressed, as shown in FIG. 6. First, large flagstones 50 are stood vertically around the outside wall of the planting shelf to form the vertical perimeter wall 70. After the perimeter wall 70 is fully formed with flagstones 50, the reserved seventeen flagstones 50 are horizontally arranged around the top edge of the perimeter of the pond to create a dressed horizontal edge 72. In the presently preferred form, two to three inches of each horizontal flagstone 50 hangs over the inside edge of the pond to provide a more natural looking finish. After all the larger stones have been placed, trim the outside edge of the pond liner 14, leaving two to three inches of liner extending beyond the dressed horizontal edge 72.

Figure 7:
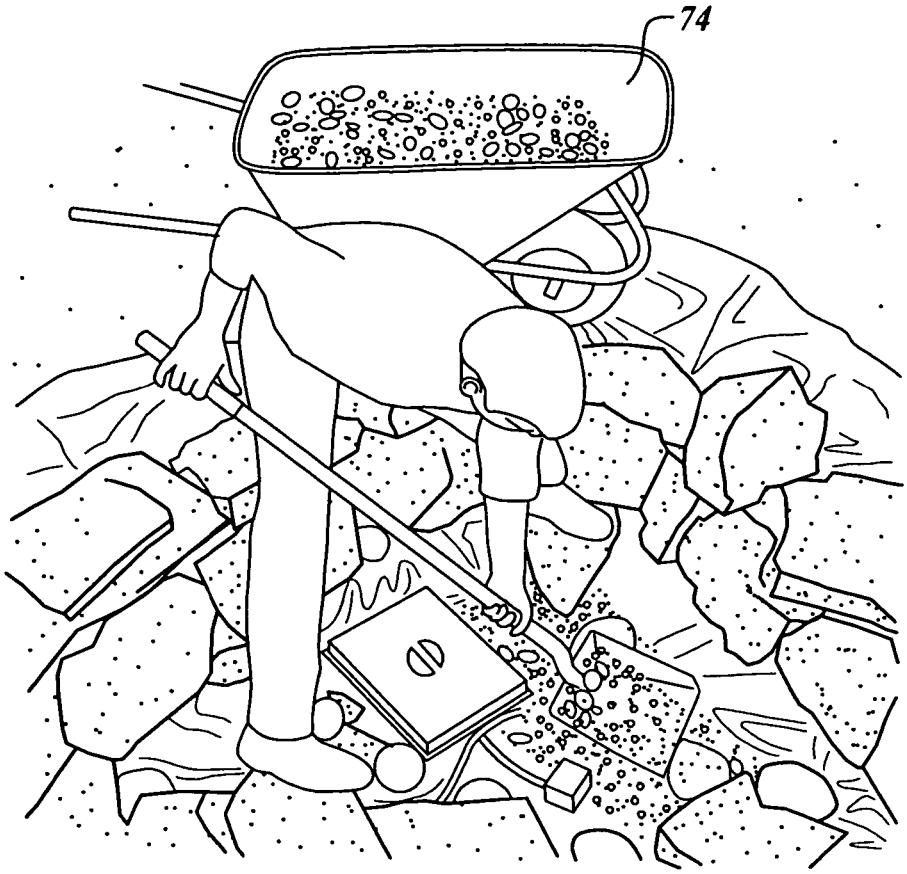
FIG. 7 is a depiction of a preferred pond with the center of the pond being filled with pebbles.
Figure 13:
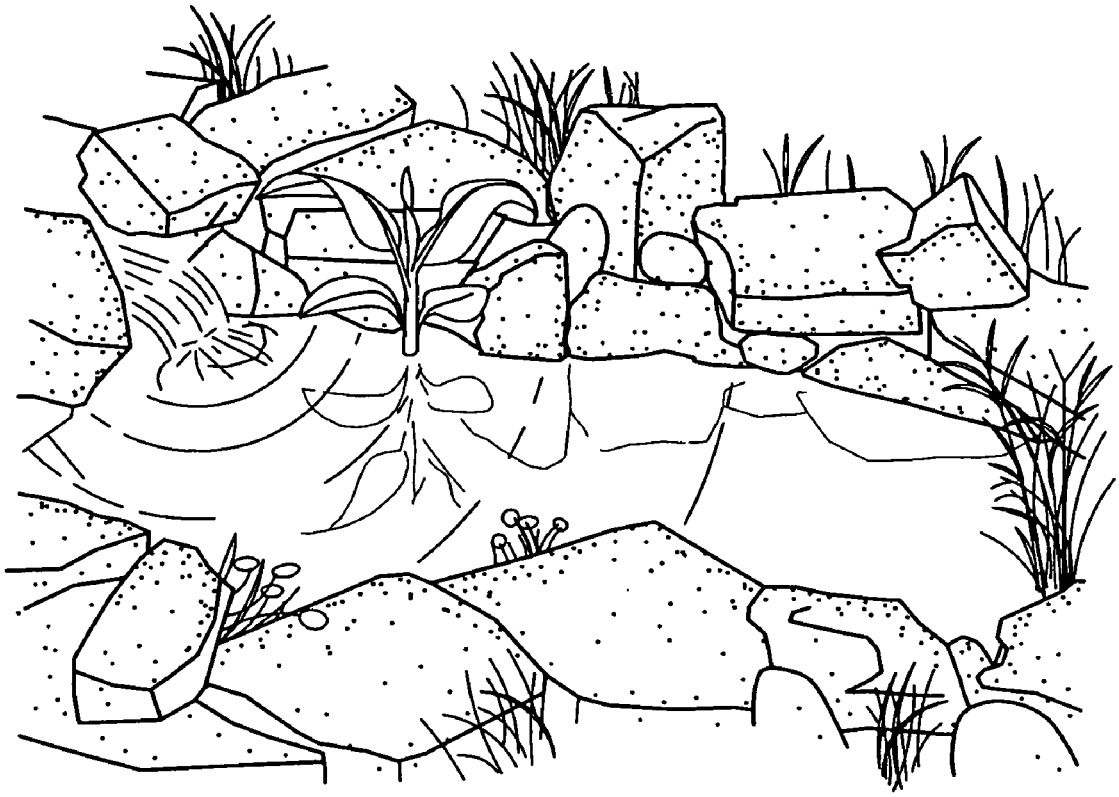
FIG. 13 a depiction of a finished pond constructed from a water feature kit in accordance with this invention.
Figure 14:
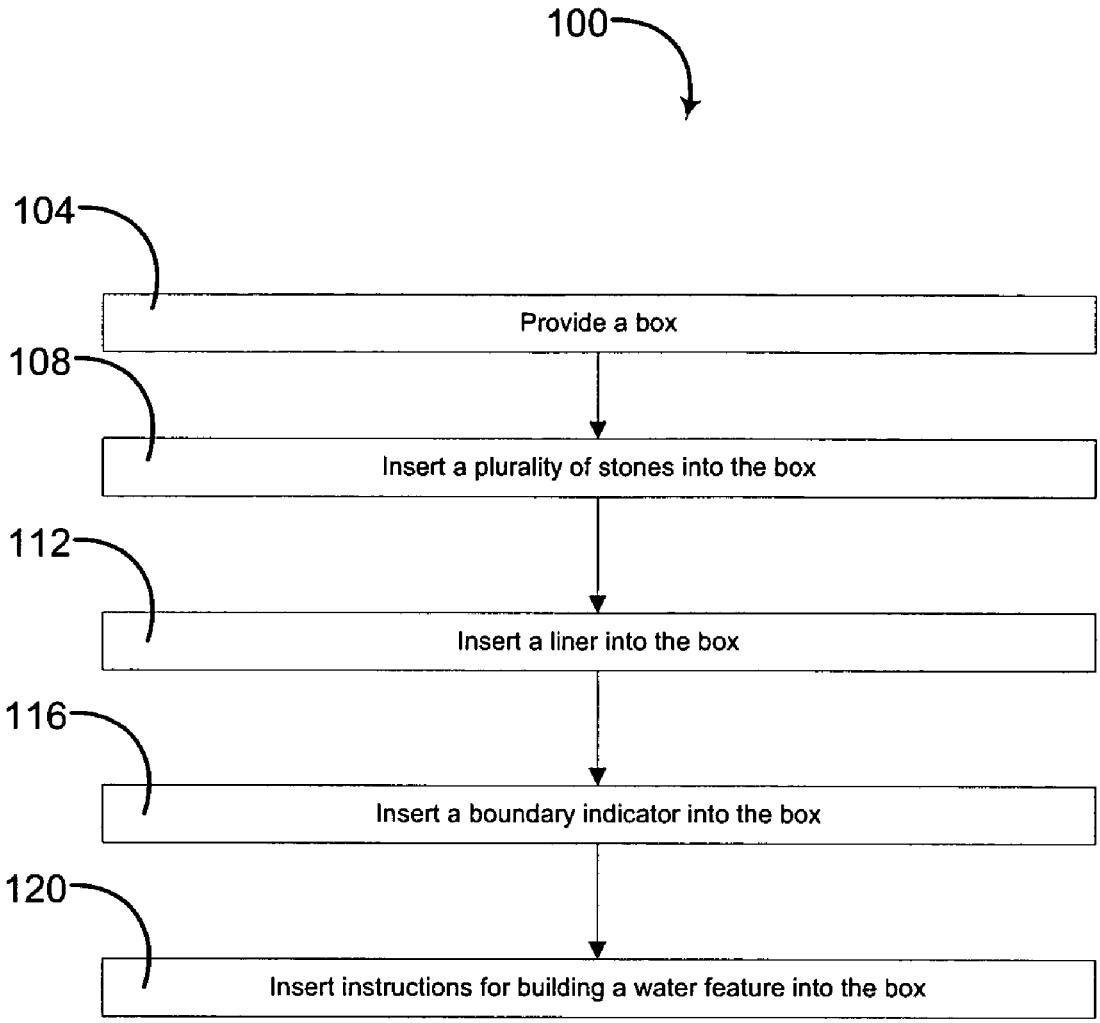
FIG. 14 is a flowchart of a method to construct a water feature kit.

Finally, the kit contains three bags of different sizes of pebbles 30, 32, 34. Although the pebbles can be used in any fashion, in the preferred form the three bags are all poured together into a wheelbarrow 74 and mixed. Use about two-thirds of this mixture to cover the bottom of the pond, as shown in FIG. 7, and to fill gaps between the larger stones in the pond. Then dress the outside of the pond with the remaining pebble mixture, filling in gaps and covering the liner 14. Once the pebbles are all in place, add water to about three inches below grade and inspect the pond for leaks. A finished pond including water plants is depicted in FIG. 13.

In an alternate form of the invention, the water feature is a waterfall rather than a pond. In this form, the kit contains many components similar to those shown in FIG. 1, but with a few differences. Thus, the kit 10 includes:

A rugged box 12

A five foot by ten foot liner 14

A water pump 15

A ten foot hose (not shown)

An 80 pound sack of ¼ inch pebbles 30

An 80 pound sack of ⅝ inch pebbles 32

An 80 pound sack of 1½ inch pebbles 34

Two sacks of cobble stones 36

A can of marking paint 42

A can of spray foam (not shown)

Twelve pieces of two to three inch flagstone 50

Twenty pieces of wall rock 52 (somewhat larger than flagstone 50)

One bag of mortar (not shown)

The construction of a waterfall using the components in the kit is somewhat similar to the construction of a pond, although the kit is intended to form a waterfall that drains into a pond as constructed above. Thus, initially a suitable location is selected for the waterfall to join with the previously constructed pond.

Using the marking paint, mark a six to seven foot section along the perimeter of the pond where the water from the waterfall will enter the pond. If the pond is filled with water, it is drained. Likewise, the stones along the marked section of the pond perimeter are removed.

Figure 8:
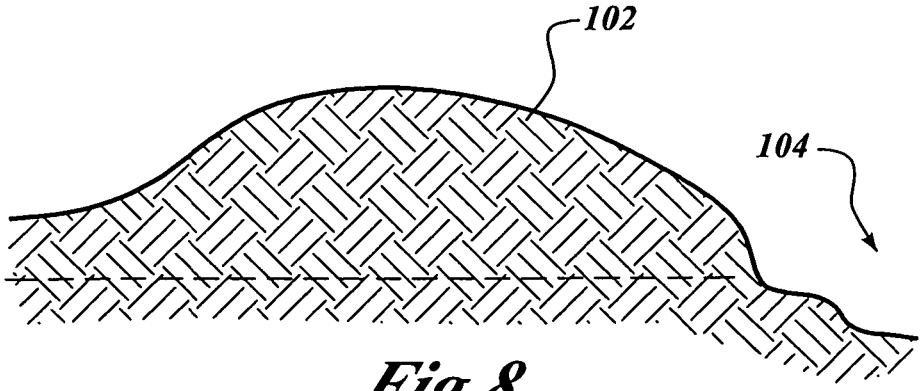
FIG. 8 is an illustration of a cross-section of a mound created for a preferred waterfall.

The next step is to build a mound to serve as the base of the waterfall. As shown in cross-section in FIG. 8, the mound 102 will be built adjacent the pond 104. In a preferred embodiment, the mound 102 is about two feet high, seven to ten feet long, and five to eight feet wide. As the mound 102 is built, the soil should be firmly compacted with the addition of every four inches to provide a firm soil structure for carving the steps of the waterfall.

Figure 9:
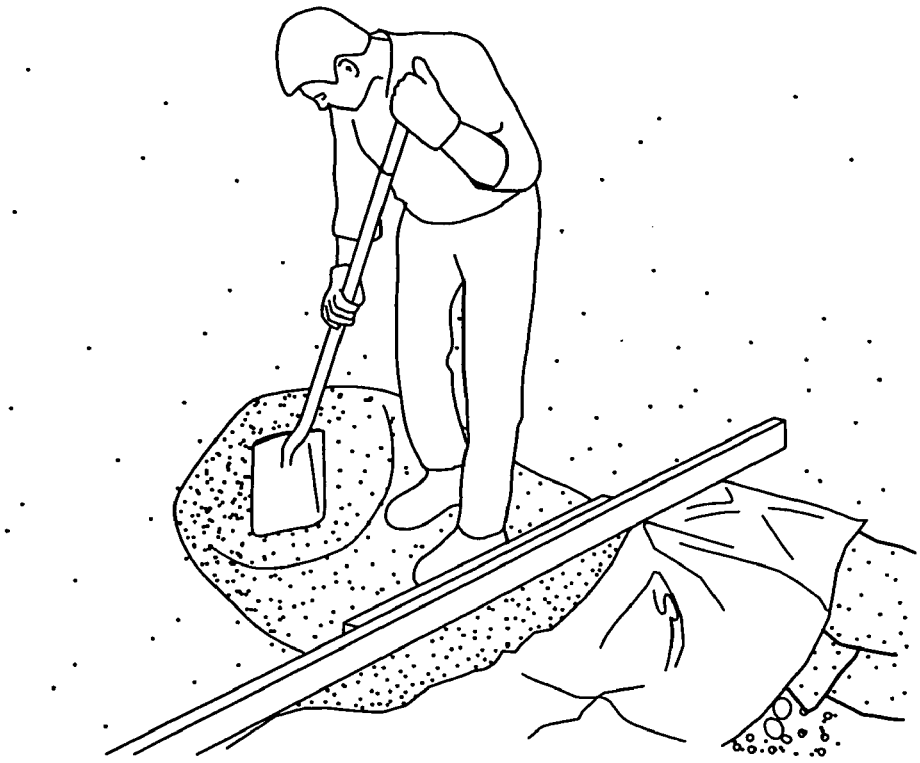
FIG. 9 is a depiction of a preferred mound being sculpted for a waterfall.
Figure 10:
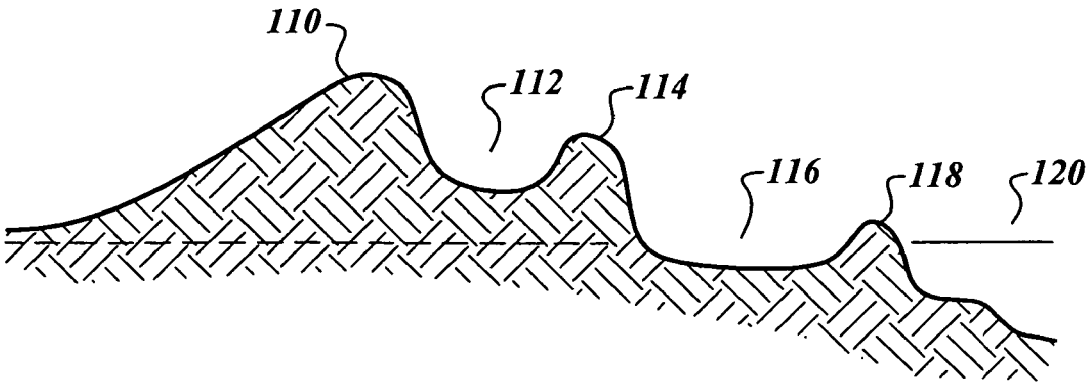
FIG. 10 is an illustration of a cross-section of a sculpted mound for a waterfall.

After the mound 102 has been built, it can be sculpted using a shovel or other suitable tools as shown in FIG. 9 to produce a tailored watercourse. The kit 10 components includes enough materials for a watercourse including two tiered falls and two pools. A cross-section of such a sculpted mound 102 is shown in FIG. 10, which includes a peak 110 from which water falls to an upper intake pool 112 bounded by an intermediate dam 114. Water collecting in the upper intake pool 112 will eventually overflow the intermediate dam 114 and into a lower intake pool 116, where it is retained by a lower dam 118. As water collects in the lower intake pool, it will eventually overflow the lower dam 118 and run into the pond 120.

As in the first embodiment, the pump 14 from the waterfall kit 10 should be placed in the deepest part of the pond 120 and hidden by stones. Placing the pond under or close to the waterfall will also help to hide the pump from view. The hose provided with the kit is then connected at one end to the pump 14 in the pond. It is extended around the outside of the watercourse or buried under earth beneath or along the perimeter of the pond and hidden by stones as it runs from the pump to the upper peak 110. An optional control valve can be installed in line with the hose at the top of the upper peak to control the volume of water entering the upper intake pool 112.

Figure 11:
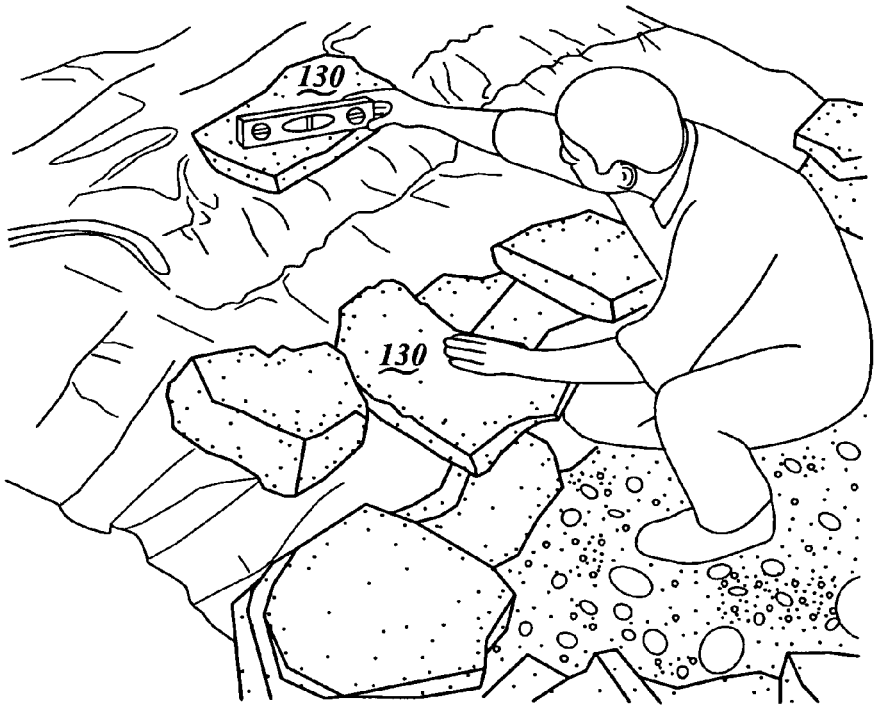
FIG. 11 is a depiction of a waterfall with horizontal step stones being placed in position.

With the mound 102 tailored to create the watercourse and the pump and hose in place, the liner 14 is set into the ground along the watercourse. The liner should be tucked fully into the edges to form the pools, and should overlap the pond liner 14 by at least eighteen inches. Next, as shown in FIG. 11, flagstones 150 are selected for the horizontal steps 130 of the waterfall, choosing flagstones 150 that are the right size and shape to provide level steps 130.

With the waterfall steps 130 temporarily in place, place the rest of the flagstones 52 in the watercourse. From the pond 120 to the top of the mound 102, the flagstones 52 that were removed from the pond 120 at the start of the construction of the watercourse and then position all of the remaining flagstones 52.

Figure 12:
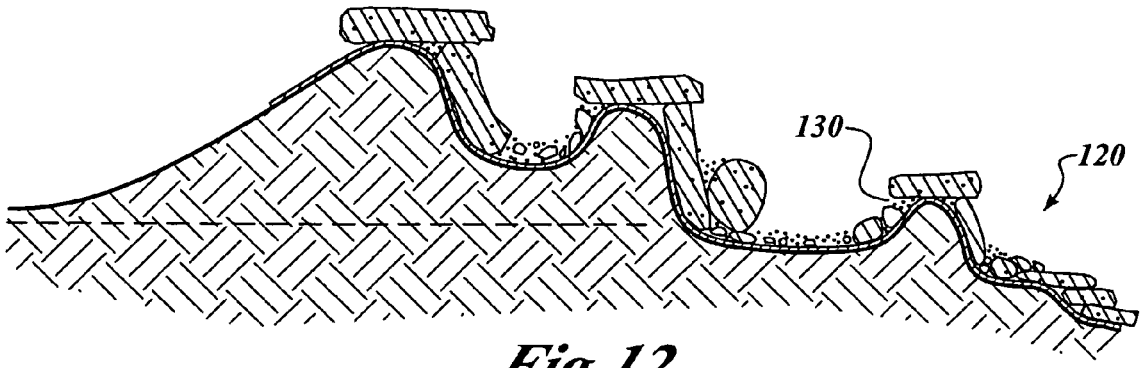
FIG. 12 is a depiction of a portion of a waterfall with additional boulders in place and mortar being used to set the stones permanently.

Once all of the flagstones 52 have been placed in position, the flagstones 52 may be permanently set with mortar 130, as shown in FIG. 12. The mortar 130 ensures that the flagstones 52 remain level and that water does not leak under the flagstones 52, but rather flows over the top and into the pond 120. Working from the bottom to the top, place a half-inch layer of the mortar 130 is tuck-pointed in place between the flagstones 52 and between the flagstones 52 and the wall rock 50.

To complete the pond, the cobblestones 36 and pebbles 30, 32, 34 are scattered into the waterfall pools to imbed them into the mortar. The waterproof integrity of the pond 120 is further enhanced by means of spray foam injected to fill any gaps underneath the waterfall steps that the mortar 130 may have missed. When the mortar 130 and spray foam have fully set, the pond 120 is refilled with the water. The remaining cobblestones 36 and mixed pebbles 30, 32, 34 are scattered throughout the watercourse, filling any gaps and covering any exposed liner.

With the pond 120 fully constructed and the mortar 130 and foam fully cured, the pond 120 can be filled with water and the pump turned on. The completed pond appears as shown in FIG. 13.

A method for assembling the kit commences by providing a box for containing the kit at a block 104. While a box is presently preferred, the invention is not limited to a single box. A set of boxes will serve appropriately or even a set of sealed buckets or a mesh of netting. Any container or set of containers will suffice so long the set of containers are used to contain a complete, single-use, kit.

Suitable stones are assembled and inserted into the box at a block 108. Often, the stones are graded, and grouped according to grade and placed in sacks before inserting into the box. Suitable grades include pebbles of various sizes, cobblestones, flagstones, and wall rock.

A liner is inserted into the box at a block 112. The liner provides the barrier to prevent water from seeping out of the pool to saturate the ground surrounding the pond. Losing water from the pond would endanger such fish, plants, and algae as the pond contains. Additionally, damage to the pump will likely occur if the pump is allowed to run without water in the pond.

A boundary indicator is inserted into the box at a block 116. Boundary indicators might be chains, cords, stakes, or lime. In the presently preferred embodiment, spray paint in a can is used to mark a shape of an excavation.

Instructions to construct a water feature are inserted into the box at a block 120. The instructions are advantageously and optionally illustrated with illustrations of the contents of the box. Further illustrations may include use of each of the contents in their turn to construct the water feature, for instance the use of spray paint to mark earth for removal.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A kit for building a pond, the kit comprising:
- a boundary indicator;
- a liner having a first and a second side, the liner configured to inhibit migration of water from the first side to the second side;
- a plurality of stones;
- a package of mortar;
- a pump with nozzle, configured to motivate water; and
- a container, the container enclosing the boundary indicator, liner, stones, the package of mortar, and the pump with nozzle;
- an instruction set within the container, the instruction kit including instructions for:
  - placing the boundary indicator to indicate an area selected for defining an excavation having an edge and a surface;
  - moving material to define the excavation to have the edge substantially coincide with the boundary indicator;
  - setting the liner on the surface; and
  - placing stones on the liner to form a pond for receiving water,
- wherein the size of the boundary indicator, the liner, the pump, and the package of mortar and the number of stones are based on predefined pond size.

2. The kit of claim 1, wherein, the container comprises a box.

3. The kit of claim 1, wherein the stones are sorted into a plurality of grades according to size, each of the grades of stones being packaged in separate packages and enclosed within the container.

4. The kit of claim 3, wherein the grades include pebbles, cobble stones, flagstones, and wall rock.

5. The kit of claim 1, wherein the boundary indicator includes a rope and spray paint.

* * * * *